US011670254B2

(12) United States Patent
Higuchi

(10) Patent No.: US 11,670,254 B2
(45) Date of Patent: Jun. 6, 2023

(54) DISPLAY DRIVER AND DISPLAY DEVICE HAVING VARIABLE REFRESH RATE SYNCHRONIZATION FUNCTION SUPPRESSING FLICKER OCCURRENCE

(71) Applicant: LAPIS Technology Co., Ltd., Yokohama (JP)

(72) Inventor: Koji Higuchi, Yokohama (JP)

(73) Assignee: LAPIS TECHNOLOGY CO., LTD., Yokohama (JP)

( * ) Notice: Subject to any disclaimer, the term of this patent is extended or adjusted under 35 U.S.C. 154(b) by 0 days.

(21) Appl. No.: 17/674,693

(22) Filed: Feb. 17, 2022

(65) Prior Publication Data

US 2022/0277705 A1 Sep. 1, 2022

(30) Foreign Application Priority Data

Feb. 26, 2021 (JP) ..... JP2021-29565

(51) Int. Cl.
*G09G 3/36* (2006.01)

(52) U.S. Cl.
CPC ... *G09G 3/3696* (2013.01); *G09G 2310/0291* (2013.01); *G09G 2320/0276* (2013.01)

(58) Field of Classification Search
CPC ..... G09G 3/36; G09G 3/3611; G09G 3/3614; G09G 3/3622; G09G 3/3625; G09G 3/3648; G09G 3/3674; G09G 3/3677; G09G 3/3681; G09G 3/3685; G09G 3/3688; G09G 3/3692; G09G 3/3696; G09G 2320/0276
USPC ..... 345/87–104
See application file for complete search history.

(56) References Cited

U.S. PATENT DOCUMENTS 9,570,011 B2 * 2/2017 Shiibayashi ..... G09G 3/3406
10,199,000 B2 * 2/2019 Shiibayashi ..... G09G 3/3406
2015/0145898 A1 * 5/2015 Hwang ..... G09G 3/3614 345/96
2015/0248865 A1 * 9/2015 Lim ..... G09G 3/3666 345/691

(Continued)

FOREIGN PATENT DOCUMENTS

JP 2006-330292 A 12/2006

*Primary Examiner* — Amit Chatly
*Assistant Examiner* — Nelson Lam
(74) *Attorney, Agent, or Firm* — Rabin & Berdo, P.C.

(57) ABSTRACT

The present invention includes a common voltage generation part, a reference gamma voltage generation part, a gamma compensation part, a gradation voltage generating circuit, and a DA conversion part. The common voltage generation part generates a common voltage by amplifying a reference common voltage and applies the common voltage to a common electrode of a display panel. The reference gamma voltage generation part generates reference gamma voltages. The gamma compensation part takes in a voltage of the common electrode as a feedback common voltage from the display panel and generates compensation reference gamma voltages in which voltage values of the respective reference gamma voltages are adjusted on the basis of a difference between the feedback common voltage and the reference common voltage. The gradation voltage generating circuit generates gradation voltages on the basis of the compensation reference gamma voltages. The DA conversion part selects a gradation voltage corresponding to a display data piece from the gradation voltages.

4 Claims, 9 Drawing Sheets

(56) References Cited

U.S. PATENT DOCUMENTS

| | | | | |
|---|---|---|---|---|
| 2015/0348488 | A1* | 12/2015 | Wu | G09G 3/3696 345/94 |
| 2017/0358277 | A1* | 12/2017 | Yamazaki | G09G 3/3426 |
| 2018/0130417 | A1* | 5/2018 | Yamazaki | G09G 3/3677 |
| 2019/0206356 | A1* | 7/2019 | Kim | G09G 3/3655 |
| 2020/0135119 | A1* | 4/2020 | Nakayama | G09G 3/2003 |
| 2021/0090519 | A1* | 3/2021 | Tsuchi | G09G 3/3688 |

* cited by examiner

DISPLAY DRIVER AND DISPLAY DEVICE HAVING VARIABLE REFRESH RATE SYNCHRONIZATION FUNCTION SUPPRESSING FLICKER OCCURRENCE

CROSS-REFERENCE TO RELATED APPLICATION

This application is based upon and claims the benefit of priority from the prior Japanese Patent Application No. 2021-29565 filed on Feb. 26, 2021, the entire contents of which are incorporated herein by reference.

BACKGROUND

1. Technical Field

The present invention relates to a display driver and a display device configured to drive a display panel on the basis of a video signal.

2. Description of the Related Art

Nowadays, as a liquid crystal display device, a gaming monitor with a performance appropriate for comfortably playing electronic games has been attracting attention. The gaming monitor achieves reduction of display delay and video display with smooth move by displaying a video with a refresh rate higher than that of an ordinary monitor.

Now, for example, a video source that is used in a PC game and generates images of respective frames by real time drawing is a video of what is called a variable frame rate in which a time taken for drawing in each frame differs depending on a drawing load for each time. Accordingly, when a refresh rate on a monitor side receiving such video source is fixed, a wrong video is displayed.

Therefore, currently, the mainstream is a gaming monitor having a variable refresh rate synchronization function configured to dynamically change a refresh rate by following a video source with a variable frame rate.

However, when the refresh rate is dynamically changed in the gaming monitor side, a luminance in the whole screen is changed by a variation of a gamma characteristic due to the change of the refresh rate, thus causing a problem that it is visible as a flicker.

Therefore, there has been proposed a liquid crystal display device configured to detect a refresh rate, read a gamma value of a video optimal for the refresh rate from a memory, and change a gamma characteristic on the basis of the read gamma value, thereby suppressing a flicker (see, for example, JP-A-2006-330292). In the liquid crystal display device, a timing controller included in itself receives enable signal and clock signal indicating a display timing with display data, and detects a refresh rate on the basis of these enable signal and clock signal.

SUMMARY OF THE INVENTION

In the liquid crystal display device according to JP-A-2006-330292, whether the refresh rate has been changed or not is determined by measuring a frame length (time period) for each frame. Therefore, since the gamma value is changed after measuring the refresh rate for each frame, the timing of changing the gamma value delays by a length of at least one frame. Accordingly, such method has a problem of failing to avoid the flicker.

The present invention has an object to provide a display driver and a display device having a variable refresh rate synchronization function that allows suppressing flicker occurrence.

A display driver according to the present invention is a display driver for driving a display panel on the basis of a video signal. The display panel includes display cells and a common electrode connected to the display cells in common. The display driver includes a common voltage generation part, a reference gamma voltage generation part, a gamma compensation part, a gradation voltage generating circuit, and a DA conversion part. The common voltage generation part receives a reference common voltage, generates a common voltage by amplifying the reference common voltage, and applies the common voltage to the common electrode. The reference gamma voltage generation part generates first to k-th (k is an integer of 2 or more) reference gamma voltages based on a predetermined gamma characteristic. The gamma compensation part takes in a voltage of the common electrode as a feedback common voltage from the display panel, and generates first to k-th compensation reference gamma voltages in which voltage values of the respective first to k-th reference gamma voltages are adjusted on the basis of a difference between the feedback common voltage and the reference common voltage. The gradation voltage generating circuit generates gradation voltages on the basis of the first to k-th compensation reference gamma voltages. The DA conversion part selects a gradation voltage corresponding to a display data piece from the gradation voltages for each of display data pieces corresponding to the respective display cells based on the video signal, and supplies the selected gradation voltage as a driving voltage to the display panel.

A display device according to the present invention includes a display panel and a display driver. The display panel includes display cells, a common electrode connected to the display cells in common, and first and second terminals connected to the common electrode. The display driver supplies driving voltages based on a video signal and a common voltage to the display panel. The display driver includes a common voltage generation part, a reference gamma voltage generation part, a gamma compensation part, a gradation voltage generating circuit, and a DA conversion part. The common voltage generation part receives a reference common voltage, generates the common voltage by amplifying the reference common voltage, and applies the common voltage to the first terminal. The reference gamma voltage generation part generates first to k-th (k is an integer of 2 or more) reference gamma voltages based on a predetermined gamma characteristic. The gamma compensation part takes in a voltage of the second terminal as a feedback common voltage from the display panel, and generates first to k-th compensation reference gamma voltages in which voltage values of the respective first to k-th reference gamma voltages are adjusted on the basis of a difference between the feedback common voltage and the reference common voltage. The gradation voltage generating circuit generates gradation voltages on the basis of the first to k-th compensation reference gamma voltages. The DA conversion part selects a gradation voltage corresponding to a display data piece from the gradation voltages for each of display data pieces corresponding to the respective display cells based on the video signal, and supplies the selected gradation voltage as the driving voltage to the display panel.

Advantageous Effects of Invention

In the present invention, the common voltage obtained by amplifying the reference common voltage is applied to the common electrode of the display panel, and the voltage of the common electrode is taken in as the feedback common voltage. Then, the voltage value of the reference gamma voltage of which the gradation voltages are based is adjusted on the basis of the difference between the feedback common voltage and the reference common voltage, thereby compensating for the fluctuation amount of the common voltage.

Accordingly, even when the voltage of the common electrode of the display panel (common voltage) is fluctuated by the change of the refresh rate or the like, since the change of the display luminance caused by the voltage fluctuation can be quickly suppressed while following the voltage fluctuation, the flicker occurrence can be suppressed.

DETAILED DESCRIPTION

Embodiments of the present invention will be described in detail below with reference to the drawings.

Figure 1:
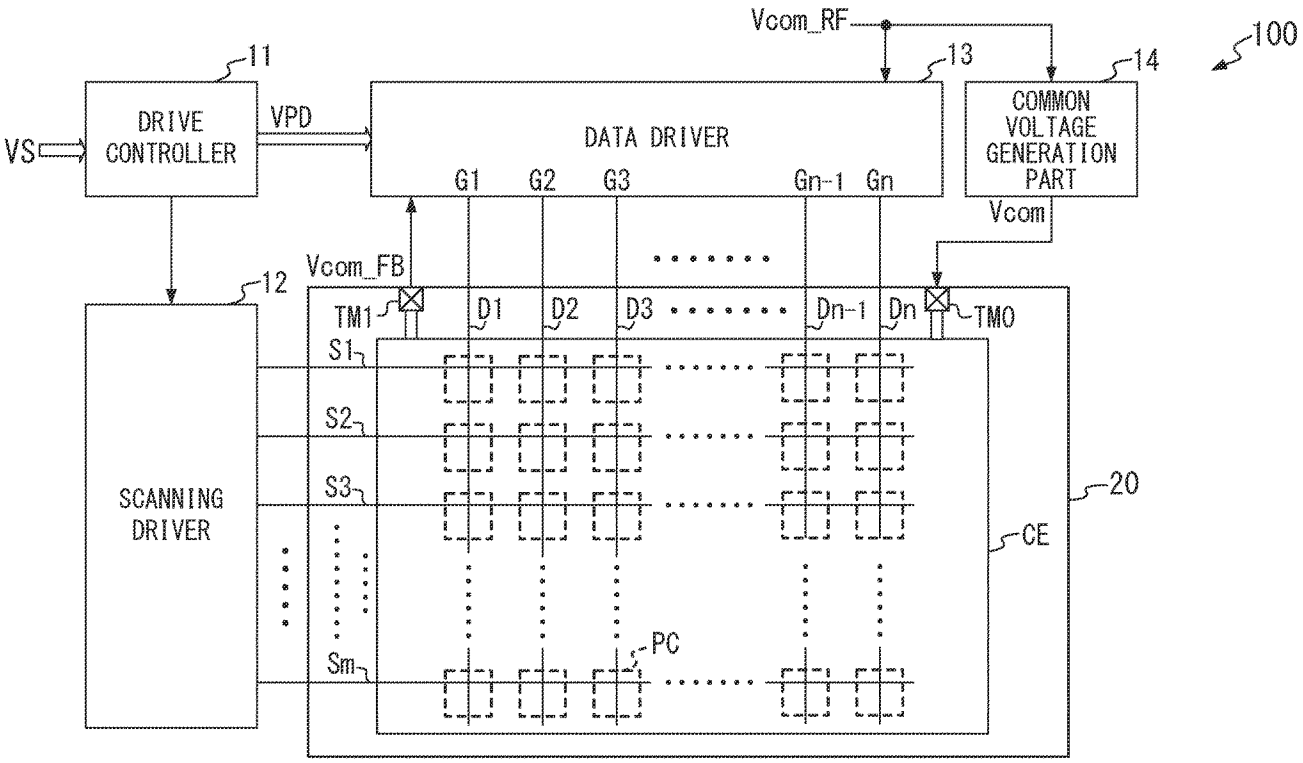
FIG. 1 is a block diagram illustrating a configuration of a display device 100 that includes a display driver according to the embodiment.

FIG. 1 is a block diagram illustrating a configuration of a display device 100 according to the present invention.

The display device 100 is, for example, a liquid crystal display device having a variable refresh rate synchronization function, and includes a drive controller 11, a scanning driver 12, and a display panel 20, and a data driver 13 and a common voltage generation part 14 constituting a display driver according to the present invention.

In the display panel 20, scanning lines S1 to Sm (m is an integer of 2 or more) each extending in a horizontal direction of a two-dimensional screen and data lines D1 to Dn (n is an integer of 2 or more) each extending in a vertical direction of the two-dimensional screen are disposed to be intersected. At intersecting portions of the scanning lines and the data lines, for example, display cells PC as liquid crystal display elements are formed. The display panel 20 includes a plate-shaped common electrode CE, a terminal TM0 for inputting a common voltage to the common electrode CE, and a terminal TM1 for extracting a voltage of the common electrode CE.

Figure 2:
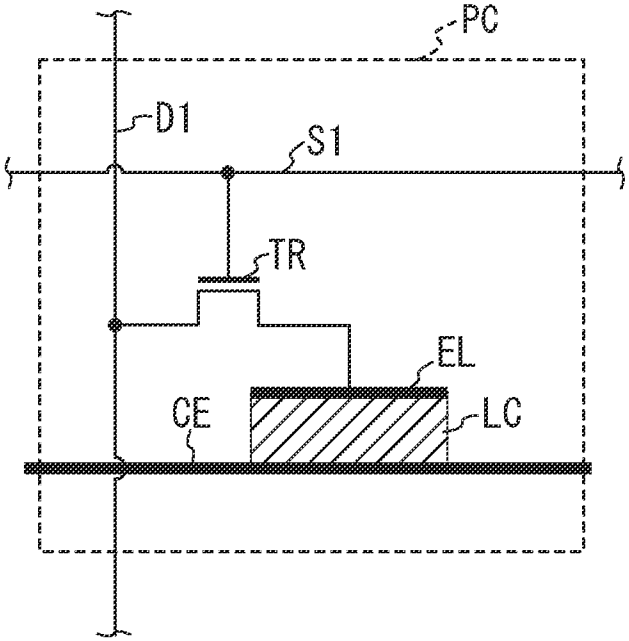
FIG. 2 is a circuit diagram illustrating an exemplary equivalent circuit of display cells PC.

FIG. 2 is a circuit diagram illustrating an exemplary equivalent circuit of the display cells PC extracting the display cell PC formed at the intersecting portion of the data line D1 and the scanning line S1.

As illustrated in FIG. 2, the display cell PC includes a pixel electrode EL and a liquid crystal layer LC, which are laminated on the common electrode CE, and a MOS type thin film transistor TR as a pixel switch. The pixel electrode EL is a transparent electrode independently disposed for each display cell PC, and the common electrode CE is a single transparent electrode formed corresponding to formation regions of all display cells PC of the display panel 20. The transistor TR has a gate connected to the scanning line S1, and the transistor TR has a source connected to the data line D1. The transistor TR has a drain connected to the pixel electrode EL.

In FIG. 1, the drive controller 11 receives a video signal VS, detects a horizontal synchronization signal from the video signal VS, and supplies the horizontal synchronization signal to the scanning driver 12. The drive controller 11 generates an image data signal VPD based on the video signal VS. The image data signal VPD includes a series of display data pieces representing the luminance levels of respective display cells PC by, for example, 8-bit gradation. The drive controller 11 supplies the image data signal VPD to the data driver 13. The drive controller 11 adjusts a length of a vertical blanking period in each frame of the image data signal VPD by following a frequency of a vertical synchronization signal of the video signal VS.

The scanning driver 12 applies selection signals including selection pulses sequentially and alternatively to the respective scanning lines S1 to Sm corresponding to the horizontal synchronization signal.

The data driver 13 converts the respective display data pieces to gradation voltages corresponding to luminance levels indicated by the display data pieces every n display data pieces of one horizontal scanning in the series of the display data pieces included in the image data signal VPD. The data driver 13 amplifies the gradation voltages corresponding to the respective n display data pieces to generate n driving voltages G1 to Gn, and applies the driving voltages G1 to Gn to the data lines D1 to Dn of the display panel 20, respectively.

The data driver 13 receives a reference common voltage Vcom_RF, and takes in the voltage of the common electrode CE as a feedback common voltage Vcom_FB from the terminal TM1 of the display panel 20. The data driver 13 adjusts a voltage value of the gradation voltage on the basis of a difference between the reference common voltage Vcom_RF and the feedback common voltage Vcom_FB.

The data driver 13 is formed in a single semiconductor chip, or formed to be divided in a plurality of semiconductor chips.

The common voltage generation part 14 receives the reference common voltage Vcom_RF, and generates an intermediate voltage in a range of a voltage value possible as the gradation voltage, that is, a voltage as a border between a positive electrode side voltage value and negative electrode side voltage value of the gradation voltage, as a common voltage Vcom of a direct current on the basis of the reference common voltage Vcom_RF. The common voltage generation part 14 supplies the common voltage Vcom to the terminal TM0 of the display panel 20. Thus, the common voltage Vcom is applied to the liquid crystal layers LC included in all of the display cells PC formed in the display panel 20 via the common electrode CE. The common voltage generation part 14 is formed in a semiconductor chip different from the semiconductor chip in which the data driver 13 is formed. The common voltage generation part 14 may be formed in the semiconductor chip in which the data driver 13 is formed.

Figure 3:
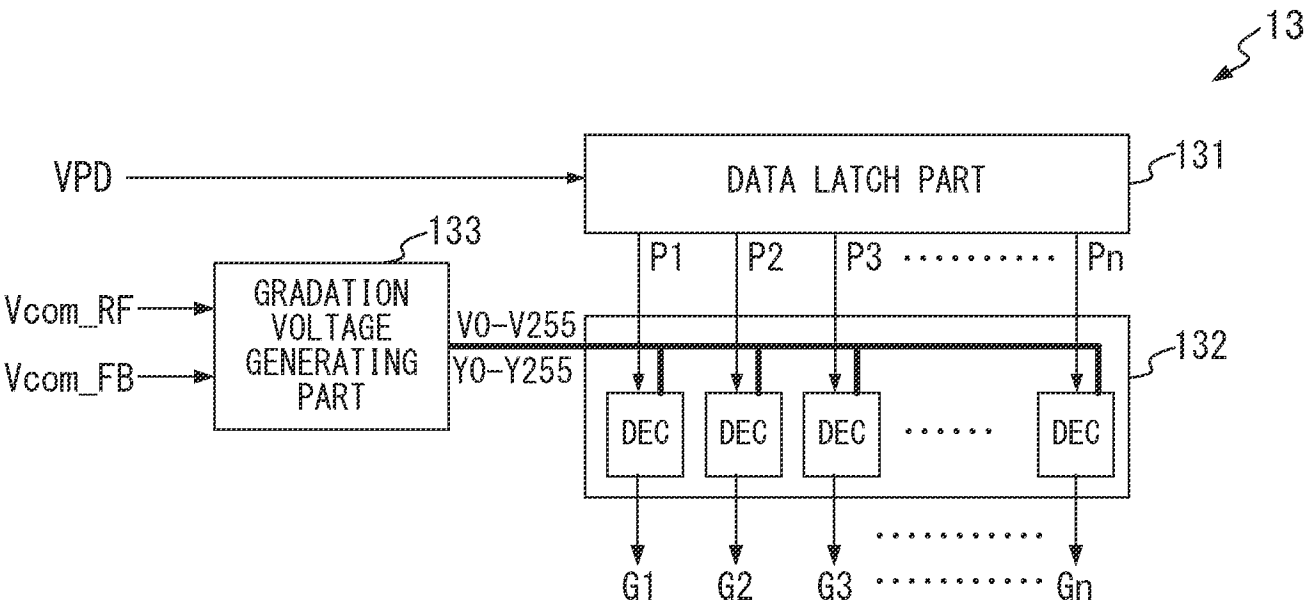
FIG. 3 is a block diagram illustrating an internal configuration of a data driver 13.

FIG. 3 is a block diagram illustrating an exemplary internal configuration of the data driver 13.

As illustrated in FIG. 3, the data driver 13 includes a data latch part 131, a DA conversion part 132, and a gradation voltage generating part 133.

The data latch part 131 retrieves the display data pieces included in the image data signal VPD for every n pieces of one horizontal scanning, and supplies them as display data P1 to Pn to the DA conversion part 132.

The gradation voltage generating part 133 generates a group of 256 positive electrode side voltages having mutually different voltage values higher than that of the common voltage Vcom, and a group of 256 negative electrode side voltages having mutually different voltage values lower than that of the common voltage Vcom. The gradation voltage generating part 133 supplies the generated group of 256 positive electrode side voltages to the DA conversion part 132 as gradation voltages V0 to V255 having positive voltage values representing the luminance levels to be displayed in 256 levels. The gradation voltage generating part 133 supplies the generated group of 256 negative electrode side voltages to the DA conversion part 132 as gradation voltages Y0 to Y255 having negative voltage values representing the luminance levels to be displayed in 256 levels.

Furthermore, the gradation voltage generating part 133 adjusts the respective voltage values of the gradation voltages V0 to V255 and Y0 to Y255 on the basis of the difference between the reference common voltage Vcom_RF and the feedback common voltage Vcom_FB. Each of the gradation voltages V0 to V255 and Y0 to Y255 has the voltage value based on a predetermined gamma characteristic.

The DA conversion part 132 includes n decoders (DECs). The decoders (DECs) are disposed corresponding to the respective display data P1 to Pn, and receive the gradation voltages V0 to V255 and Y0 to Y255. Each of the decoders selects one gradation voltage corresponding to the luminance level represented by the display data P received by itself among the gradation voltages V0 to V255 and Y0 to Y255, amplifies the selected gradation voltage, and applies it as a driving voltage to the corresponding data line D in the display panel 20.

That is, the DA conversion part 132 receives the display data P1 to Pn, and selects one gradation voltage corresponding to the luminance level of the display data P among the gradation voltages V0 to V255 and Y0 to Y255. The DA conversion part 132 amplifies each of the n gradation voltages obtained by the selection for each of the display data P1 to Pn, and generates them as the driving voltages G1 to Gn, respectively.

Next, configurations of the gradation voltage generating part 133 and the common voltage generation part 14 will be described in detail.

Figure 4:
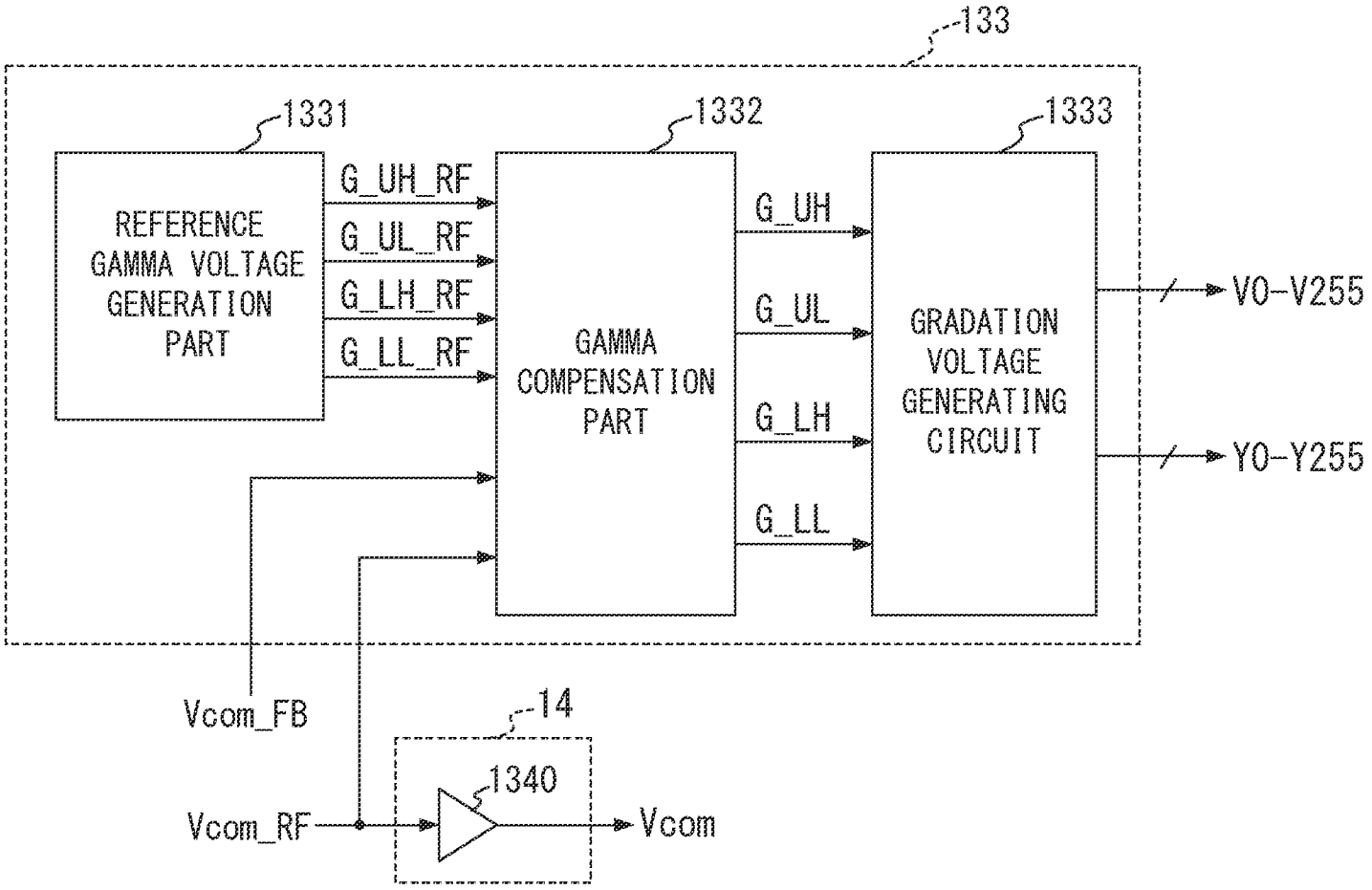
FIG. 4 is a block diagram illustrating an exemplary internal configuration of a gradation voltage generating part 133.

FIG. 4 is a block diagram illustrating internal configurations of the gradation voltage generating part 133 and the common voltage generation part 14.

As illustrated in FIG. 4, the common voltage generation part 14 includes an amplifier 1340 configured of, for example, an operational amplifier of a voltage follower configuration. The amplifier 1340 amplifies the reference common voltage Vcom_RF and outputs it as the common voltage Vcom.

The gradation voltage generating part 133 includes a reference gamma voltage generation part 1331, a gamma compensation part 1332, and a gradation voltage generating circuit 1333.

The reference gamma voltage generation part 1331 generates a reference gamma voltage G_UL_RF that is a voltage higher than the reference common voltage Vcom_RF and has a voltage value based on the predetermined gamma characteristic. The reference gamma voltage generation part 1331 generates a reference gamma voltage G_UH_RF that is a voltage higher than the reference gamma voltage G_UL_RF and has a voltage value based on the predetermined gamma characteristic. The reference gamma voltage generation part 1331 generates a reference gamma voltage G_LH_RF that is a voltage lower than the reference common voltage Vcom_RF and has a voltage value based on the predetermined gamma characteristic. The reference gamma voltage generation part 1331 generates a reference gamma voltage G_LL_RF that is a voltage lower than the reference gamma voltage G_LH_RF and has a voltage value based on the predetermined gamma characteristic.

That is, the reference gamma voltage generation part 1331 generates the four reference gamma voltages G_UH_RF, G_UL_RF, G_LH_RF, and G_LL_RF having a magnitude relationship below.

$$G_UH_RF > G_UL_RF > Vcom_RF > G_LH_RF > G_LL_RF$$

Hereinafter, the reference gamma voltages G_UH_RF and G_UL_RF higher than the reference common voltage Vcom_RF are treated as the positive electrode side voltages, and the reference gamma voltages G_LH_RF and G_LL_RF lower than the reference common voltage Vcom_RF are treated as the negative electrode side voltages.

The reference gamma voltage generation part 1331 supplies the generated reference gamma voltages G_UH_RF, G_UL_RF, G_LH_RF, and G_LL_RF to the gamma compensation part 1332.

The gamma compensation part 1332 receives the reference common voltage Vcom_RF, and takes in the voltage of the common electrode CE as the feedback common voltage Vcom_FB via the terminal TM1 of the display panel 20. The gamma compensation part 1332 adjusts the respective voltage values of the reference gamma voltages G_UH_RF, G_UL_RF, G_LH_RF, and G_LL_RF on the basis of the feedback common voltage Vcom_FB and the reference common voltage Vcom_RF. The gamma compensation part 1332 generates compensation reference gamma voltages G_UH, G_UL, G_LH, and G_LL in which the amount of voltage fluctuation of the common voltage Vcom is compensated through the adjustment.

Figure 5:
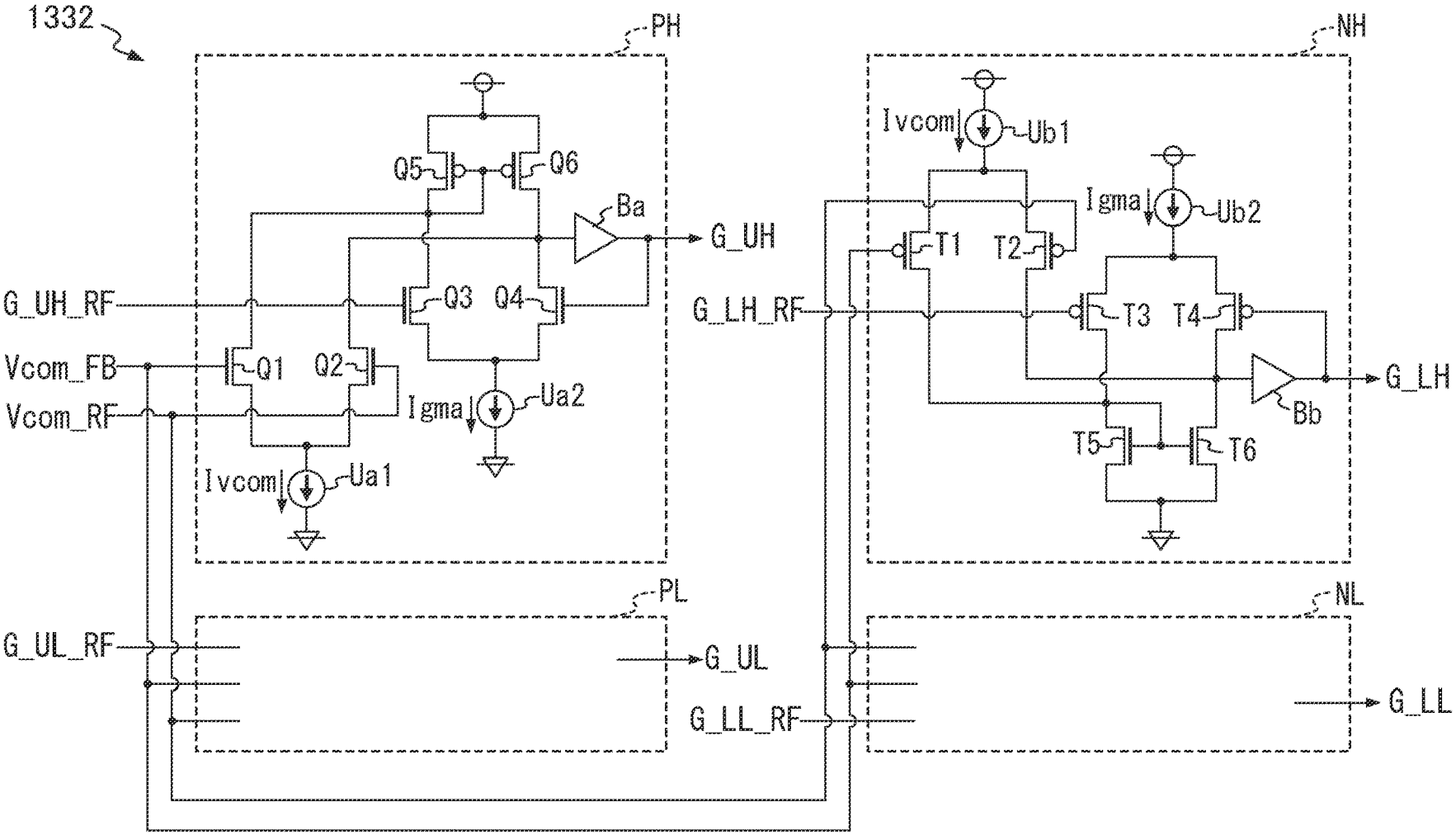
FIG. 5 is a circuit diagram illustrating an exemplary internal configuration of a gamma compensation part 1332.

FIG. 5 is a circuit diagram illustrating an exemplary internal configuration of the gamma compensation part 1332.

The gamma compensation part 1332 includes positive electrode side gamma compensation parts PH and PL, and negative electrode side gamma compensation circuits NH and NL.

As illustrated in FIG. 5, the positive electrode side gamma compensation circuit PH includes N channel metal oxide semiconductor (MOS) transistors Q1 and Q2 constituting a first differential stage (also referred to as a Vcom differential stage), and N channel MOS transistors Q3 and Q4 constituting a second differential stage (also referred to as a GMA differential stage). The positive electrode side gamma compensation circuit PH includes P channel MOS transistors Q5 and Q6 constituting a current mirror circuit as a load of the Vcom differential stage and the GMA differential stage.

Furthermore, the positive electrode side gamma compensation circuit PH includes a current source Ua1 that flows a constant current Ivcom, a current source Ua2 that flows a constant current Igma, and an amplifier Ba.

Each of the transistors Q1 and Q2 has a source connected to a high-potential side terminal of the current source Ua1. The current source Ua1 has a low-potential side terminal applied with a negative electrode power supply voltage having a voltage value equal to or less than that of the reference gamma voltage G_LH_RF. The transistor Q1 has a gate supplied with the feedback common voltage Vcom_FB, and has a drain connected to drains of the respective transistors Q3 and Q5 and gates of the respective transistors Q5 and Q6 via a node n1. The transistor Q2 has a gate supplied with the reference common voltage Vcom_RF, and has a drain connected to drains of the respective transistors Q4 and Q6 and an input port of the amplifier Bal via a node n2.

With the above-described configuration, the Vcom differential stage (Q1, Q2) flows currents obtained by dividing the constant current Ivcom into two with a ratio between magnitudes of the feedback common voltage Vcom_FB and the reference common voltage Vcom_RF to the respective nodes n1 and n2.

Each of the transistors Q3 and Q4 has a source connected to a high-potential side terminal of the current source Ua2. The current source Ua2 has a low-potential side terminal applied with the negative electrode power supply voltage. The transistor Q3 has a gate supplied with the reference gamma voltage G_UH_RF. The transistor Q4 has a gate connected to an output terminal of the amplifier Ba. Each of the transistors Q5 and Q6 has a source applied with a positive electrode power supply voltage having a voltage value equal to or more than that of the reference gamma voltage G_UH_RF. The amplifier Ba outputs a voltage obtained by amplifying a voltage generated at the node n2 as a connection point of the transistor Q6 and the transistor Q4 as the compensation reference gamma voltage G_UH.

With the above-described configuration, the GMA differential stage (Q3, Q4) flows currents obtained by dividing the constant current Igma into two with a ratio between magnitudes of the reference gamma voltage G_UH_RF and the compensation reference gamma voltage G_UH to the respective nodes n1 and n2.

The positive electrode side gamma compensation circuit PL has a circuit configuration the same as that of the positive electrode side gamma compensation circuit PH. Therefore, in FIG. 5, the detailed circuit diagram of the positive electrode side gamma compensation circuit PL is omitted. However, in the positive electrode side gamma compensation circuit PL, the reference gamma voltage G_UL_RF is received by the gate of the transistor Q3, the amplifier Ba outputs the compensation reference gamma voltage G_UL, and this compensation reference gamma voltage G_UL is supplied to the gate of the transistor Q4.

As illustrated in FIG. 5, the negative electrode side gamma compensation circuit NH includes P channel MOS transistors T1 and T2 constituting a first differential stage (also referred to as a Vcom differential stage), and P channel MOS transistors T3 and T4 constituting a second differential stage (also referred to as a GMA differential stage). The negative electrode side gamma compensation circuit NH includes N channel MOS transistors T5 and T6 constituting a current mirror circuit as a load of the Vcom differential stage and the GMA differential stage. The negative electrode side gamma compensation circuit NH includes a current source Ub1 that flows a constant current Ivcom, a current source Ub2 that flows a constant current Igma, and an amplifier Bb.

Each of the transistors T1 and T2 has a source connected to a low-potential side terminal of the current source Ub1. The current source Ub1 has a high-potential side terminal applied with a positive electrode power supply voltage. The transistor T1 has a gate supplied with the feedback common voltage Vcom_FB, and has a drain connected to drains of the respective transistors T3 and T5 and gates of the respective transistors T5 and T6 via a node nd1. The transistor T2 has a gate supplied with the reference common voltage Vcom_RF, and has a drain connected to drains of the respective transistors T4 and T6 and an input port of the amplifier Bb via a node nd2.

With the above-described configuration, the Vcom differential stage (T1, T2) flows currents obtained by dividing the constant current Ivcom into two with a ratio between magnitudes of the feedback common voltage Vcom_FB and the reference common voltage Vcom_RF to the respective nodes nd1 and nd2.

Each of the transistors T3 and T4 has a source connected to a low-potential side terminal of the current source Ub2. The current source Ub2 has a high-potential side terminal applied with the positive electrode power supply voltage. The transistor T3 has a gate supplied with the reference gamma voltage G_LH_RF. The transistor T4 has a gate connected to an output terminal of the amplifier Bb. Each of the transistors T5 and T6 has a source applied with a negative electrode power supply voltage. The amplifier Bb outputs a voltage obtained by amplifying a voltage generated at a connection point of the transistor T6 and the transistor T4 as the compensation reference gamma voltage G_LH.

With the above-described configuration, the GMA differential stage (T3, T4) flows currents obtained by dividing the constant current Igma into two with a ratio between magnitudes of the reference gamma voltage G_LH_RF and the compensation reference gamma voltage G_LH to the respective nodes nd1 and nd2.

The negative electrode side gamma compensation circuit NL has a circuit configuration the same as that of the negative electrode side gamma compensation circuit NH. Therefore, in FIG. 5, the detailed circuit diagram of the negative electrode side gamma compensation circuit NL is omitted. However, in the negative electrode side gamma compensation circuit NL, the reference gamma voltage G_LL_RF is received by the gate of the transistor T3, the amplifier Bb outputs the compensation reference gamma voltage G_LL, and this compensation reference gamma voltage G_LL is supplied to the gate of the transistor T4.

Operations of the positive electrode side gamma compensation circuits PH and PL and the negative electrode side gamma compensation circuits NH and NL illustrated in FIG. 5 will be described in detail below.

When no noise is mixed in the voltage on the common electrode CE of the display panel 20, that is, the common voltage Vcom, $$Vcom_RF = Vcom_FB$$

is satisfied. Thus, each of the Vcom differential stages (Q1, Q2, T1, T2) of the positive electrode side gamma compensation circuits PH and PL and the negative electrode side gamma compensation circuits NH and NL outputs the current of (1/2)·Ivcom. Therefore, in each of the GMA differential stages (Q3, Q4, T3, T4) of the positive electrode side gamma compensation circuits PH and PL and the negative electrode side gamma compensation circuits NH and NL, the constant current Igma is also evenly divided to be flowed. Consequently, the current of (1/2)·Ivcom+(1/2)·Igma flows into each of the current mirror circuits (Q5, Q6, T5, T6) of the positive electrode side gamma compensation circuits PH and PL and the negative electrode side gamma compensation circuits NH and NL. Accordingly, G_UH/G_UL is equal to G_UH_RF/G_UL_RF.

When a noise ΔV is mixed in the common voltage Vcom, and $$Vcom_FB = Vcom_RF + \Delta V$$

is satisfied, the currents flowing in the Vcom differential stages are as follows.

$$Vcom_FB \text{ side: } (1/2)\cdot Ivcom + (1/2)\cdot \Delta V\cdot Gmq1$$

$$Vcom_RF \text{ side: } (1/2)\cdot Ivcom - (1/2)\cdot \Delta V\cdot Gmq2$$

Gmq1: transconductance of transistor Q1

Gmq2: transconductance of transistor Q2

At this time, the current of the Vcom differential stage and the current of the GMA differential stage are joined and supplied to the current mirror circuit.

Accordingly, by the operation of the G_xx_RF side (xx is UH, UL, LH, LL) to compensate (1/2)·ΔV·Gmq1 in the Vcom_FB side, the current of (1/2)·Igma−(1/2)·ΔΔV·Gmq1 flows in the GMA differential stage. Furthermore, by the operation of the GMA_xx side to compensate (1/2)·ΔV·Gmq2 in the Vcom_RF side, the current of (1/2)·Igma+(1/2)·ΔV·Gmq2 flows. Consequently, by setting the Igma so as to have the same value in the differential stages in the Vcom side and the GMA side, G_xx=G_xx_RF+ΔV is satisfied, and the amount of voltage fluctuation of the Vcom_FB is directly added to the G_xx.

Accordingly, $$\text{G_xx} - \text{Vcom_FB} = (\text{G_xx_RF} + \Delta V) - (\text{Vcom_RF} + \Delta V) = \text{G_xx_RF} - \text{Vcom_RF}$$

is satisfied, thus making the difference between the compensation reference gamma voltage G_xx and the feedback common voltage Vcom_FB always constant.

By the operation as described above, the positive electrode side gamma compensation circuit PH generates the compensation reference gamma voltage G_UH satisfying below relative to the reference gamma voltage G_UH_RF, and outputs it via the amplifier Ba.

$$G_UH_RF + Vcom_FB = G_UH + Vcom_RF$$

That is, the positive electrode side gamma compensation circuit PH outputs the voltage obtained by adding the difference between the feedback common voltage Vcom_FB and the reference common voltage Vcom_RF to the reference gamma voltage G_UH_RF as the compensation reference gamma voltage G_UH.

The positive electrode side gamma compensation circuit PL generates the compensation reference gamma voltage G_UL satisfying below relative to the reference gamma voltage G_UL_RF, and outputs it via the amplifier Ba.

$$G_UL_RF + Vcom_FB = G_UL + Vcom_RF$$

That is, the positive electrode side gamma compensation circuit PL outputs the voltage obtained by adding the difference between the feedback common voltage Vcom_FB and the reference common voltage Vcom_RF to the reference gamma voltage G_UL_RF as the compensation reference gamma voltage G_UL.

The negative electrode side gamma compensation circuit NH generates the compensation reference gamma voltage G_LH satisfying below relative to the reference gamma voltage G_LH_RF, and outputs it via the amplifier Bb.

$$G_LH_RF + Vcom_FB = G_LH + Vcom_RF$$

That is, the negative electrode side gamma compensation circuit NH outputs the voltage obtained by adding the difference between the feedback common voltage Vcom_FB and the reference common voltage Vcom_RF to the reference gamma voltage G_LH_RF as the compensation reference gamma voltage G_LH.

The negative electrode side gamma compensation circuit NL generates the compensation reference gamma voltage G_LL satisfying below relative to the reference gamma voltage G_LL_RF, and outputs it via the amplifier Bb.

$$G_LL_RF + Vcom_FB = G_LL + Vcom_RF$$

That is, the negative electrode side gamma compensation circuit NL outputs the voltage obtained by adding the difference between the feedback common voltage Vcom_FB and the reference common voltage Vcom_RF to the reference gamma voltage G_LL_RF as the compensation reference gamma voltage G_LL.

Thus, the gamma compensation part 1332 adds the difference between the feedback common voltage Vcom_FB taken in from the display panel 20 and the reference common voltage Vcom_RF to each of the voltage values of the reference gamma voltages G_UH_RF, G_UL_RF, G_LH_RF, and G_LL_RF, thereby adjusting the voltage values of the respective reference gamma voltages. Accordingly, the gamma compensation part 1332 generates the voltages compensating for the amount of the voltage fluctuation of the common voltage Vcom for the reference gamma voltages G_UH_RF, G_UL_RF, G_LH_RF, and G_LL_RF as the compensation reference gamma voltages G_UH, G_UL, G_LH, and G_LL.

Figure 6:
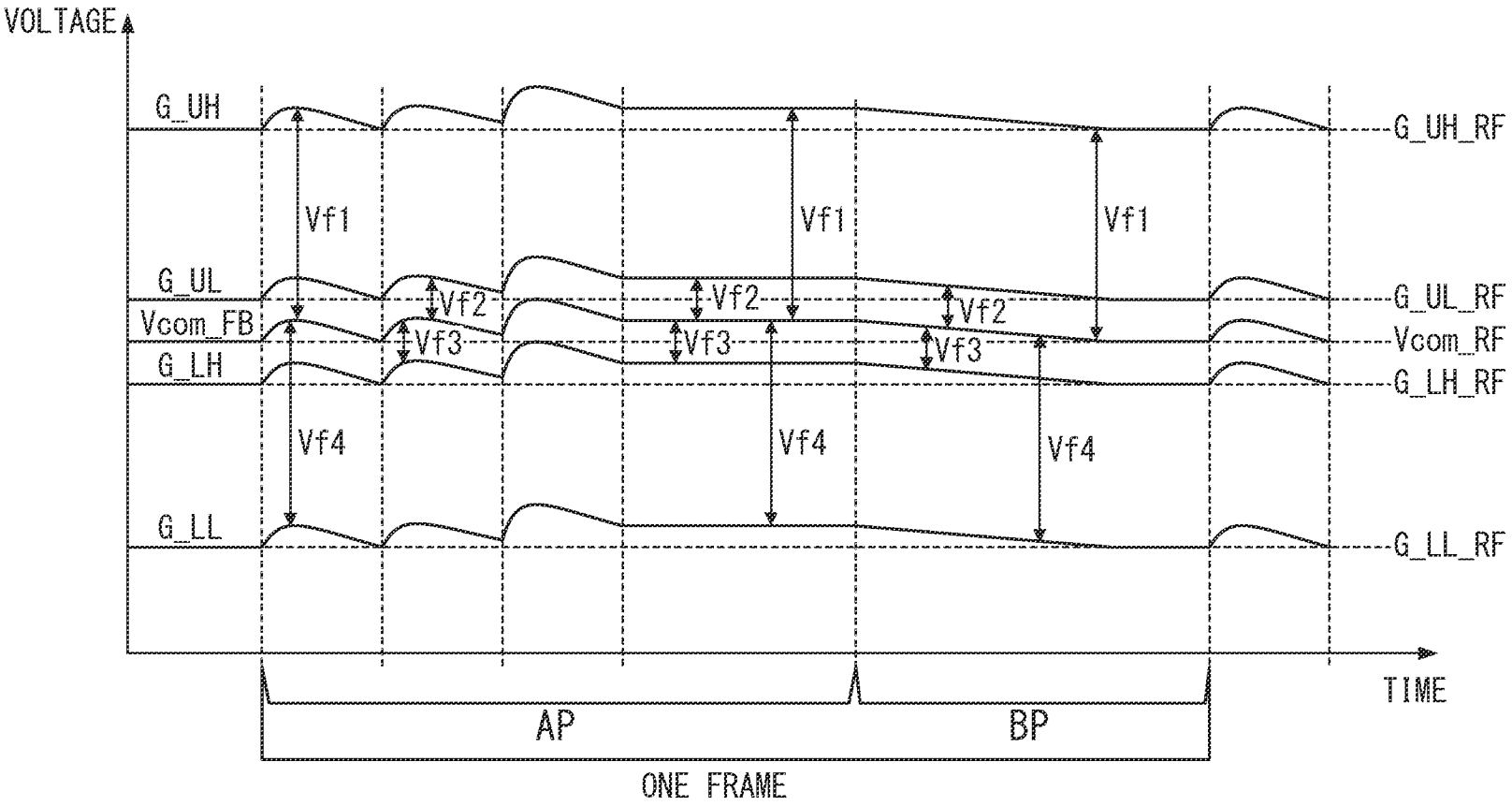
FIG. 6 is a waveform diagram illustrating transitions of respective voltage values of compensation reference gamma voltages G_UH, G_UL, G_LH, and G_LL in which a voltage fluctuation of a common voltage Vcom is compensated by the gamma compensation part 1332.

FIG. 6 is a waveform diagram illustrating transitions of respective voltage values of the compensation reference gamma voltages G_UH, G_UL, G_LH, and G_LL in which the fluctuation amount of the feedback common voltage Vcom_FB is compensated by the gamma compensation part 1332. FIG. 6 illustrates the waveforms of the respective voltages in each of an active period AP in which the data driver 13 supplies the driving voltages G1 to Gn to the display panel 20 and a vertical blanking period BP by extracting one frame.

By the gamma compensation part 1332, as illustrated in FIG. 6, regardless of the fluctuation of the feedback common voltage Vcom_FB in which the voltage fluctuation occurred on the common electrode CE of the display panel 20 is reflected, the difference between the feedback common voltage Vcom_FB and the compensation reference gamma voltage G_UH is provided as a constant voltage difference Vf1 over the active period AP and the vertical blanking period BP. The difference between the feedback common voltage Vcom_FB and the compensation reference gamma voltage G_UL is provided as a constant voltage difference Vf2. The difference between the feedback common voltage Vcom_FB and the compensation reference gamma voltage G_LH is provided as a constant voltage difference Vf3. Furthermore, the difference between the feedback common voltage Vcom_FB and the compensation reference gamma voltage G_LL is provided as a constant voltage difference Vf4.

The gamma compensation part 1332 supplies the compensation reference gamma voltages G_UH, G_UL, G_LH, and G_LL in which the amount of fluctuation of the feedback common voltage Vcom_FB is compensated as described above to the gradation voltage generating circuit 1333.

The gradation voltage generating circuit 1333 generates the gradation voltages V0 to V255 having the positive voltage values and the gradation voltages Y0 to Y255 having the negative voltage values corresponding to the respective luminance levels of, for example, 256 gradations that can be expressed by the display panel 20 on the basis of the compensation reference gamma voltages G_UH, G_UL, G_LH, and G_LL.

Figure 7:
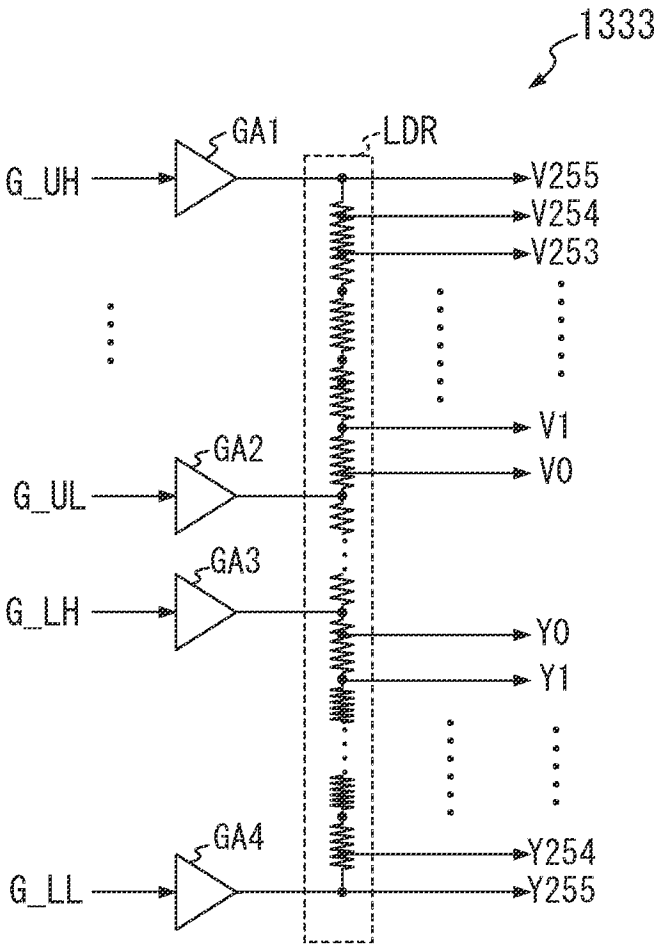
FIG. 7 is a circuit diagram illustrating an exemplary internal configuration of a gradation voltage generating circuit 1333.

FIG. 7 is a circuit diagram illustrating an exemplary configuration of the gradation voltage generating circuit 1333.

As illustrated in FIG. 7, the gradation voltage generating circuit 1333 includes gamma amplifiers GA1 to GA4 and a ladder resistor LDR.

The gamma amplifier GA1 receives the compensation reference gamma voltage G_UH, and applies a voltage obtained by amplifying the compensation reference gamma voltage G_UH with, for example, a gain 1 to one end of the ladder resistor LDR. The gamma amplifier GA4 receives the compensation reference gamma voltage G_LL, and applies a voltage obtained by amplifying the compensation reference gamma voltage G_LL with, for example, the gain 1 to the other end of the ladder resistor LDR. The gamma amplifier GA2 receives the compensation reference gamma voltage G_UL, and applies a voltage obtained by amplifying the compensation reference gamma voltage G_UL with, for example, the gain 1 to a resistor connection point in the one end side with respect to a midpoint of the ladder resistor LDR. The gamma amplifier GA3 receives the compensation reference gamma voltage G_LH and applies a voltage obtained by amplifying the compensation reference gamma voltage G_LH with, for example, the gain 1 to a resistor connection point on the other end side with respect to the midpoint of the ladder resistor LDR.

The ladder resistor LDR includes a resistor group including resistors connected in series, receives the compensation reference gamma voltages G_UH, G_UL, G_LH, and G_LL, and outputs voltages generated at 512 connection points of the resistors as the gradation voltages V0 to V255 and Y0 to Y255. That is, the ladder resistor LDR divides the voltage between the compensation reference gamma voltages G_UH and G_UL to generate the gradation voltages V0 to V255 as a positive gradation voltage group, and outputs them to the DA conversion part 132. Furthermore, the ladder resistor LDR divides the voltage between the compensation reference gamma voltages G_LH and G_LL to generate the gradation voltages Y0 to Y255 as a negative gradation voltage group, and outputs them to the DA conversion part 132.

The following describes a process of suppressing a luminance change in a display image caused by a change of a refresh rate performed by the display device 100 having the variable refresh rate synchronization function.

Figure 8:
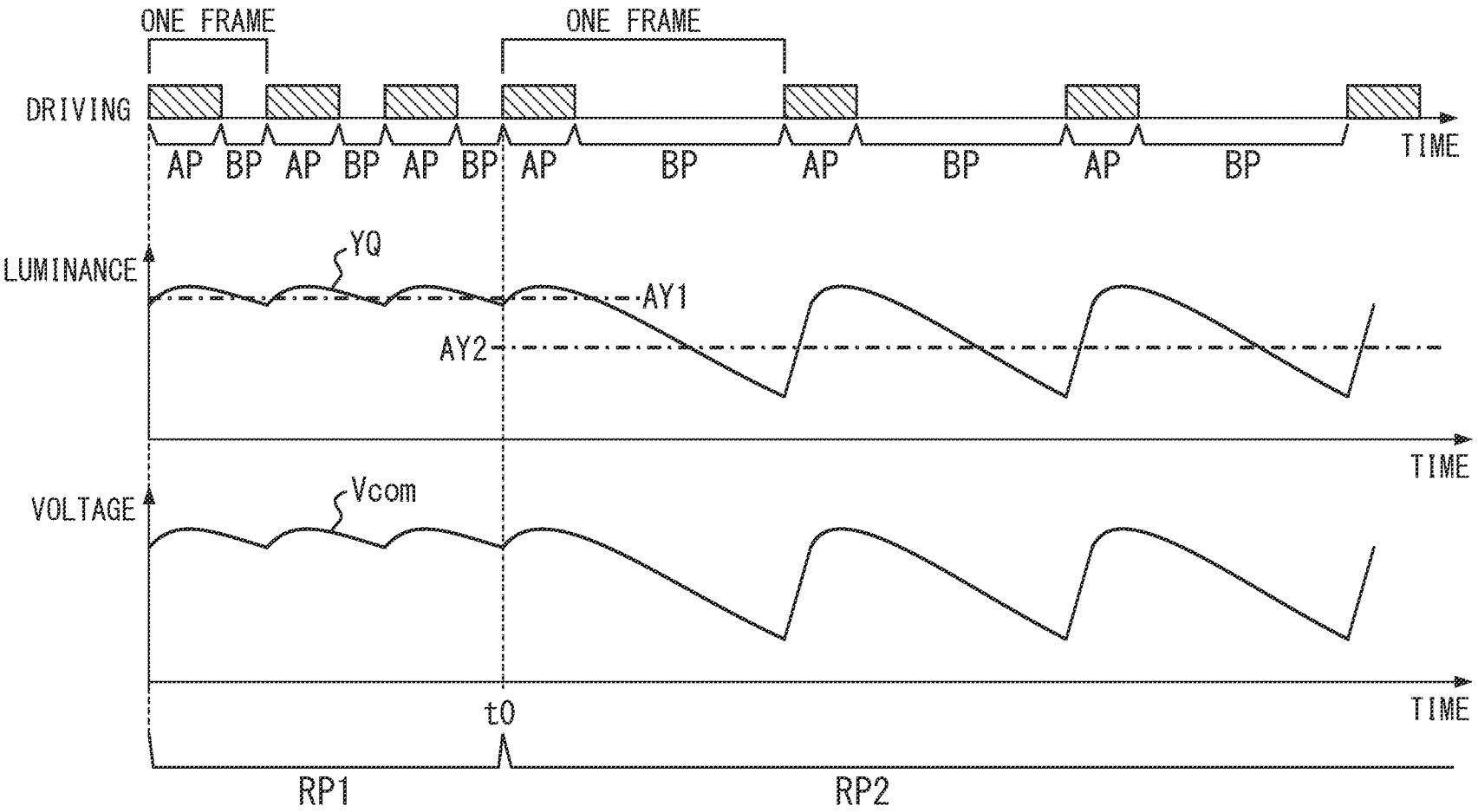
FIG. 8 is a waveform diagram schematically illustrating an exemplary form of a luminance change in a display image caused by a refresh rate change.

FIG. 8 is a waveform diagram schematically illustrating an exemplary form of the luminance change in the display image caused by the refresh rate change.

In FIG. 8, the luminance change in the display image when a display driving (high RF driving RP1) with a high frequency refresh rate is performed first and switched to a display driving (low RF driving RP2) with a low frequency refresh rate at a time point t0 is illustrated as a luminance YQ. In the example illustrated in FIG. 8, it is assumed that the driving for displaying the image with the same luminance is performed in both of the period of performing the high RF driving RP1 and the period of performing the low RF driving RP2. With the variable refresh rate synchronization function, in both cases of performing the high RF driving RP1 and the low RF driving RP2, while the lengths of the active period AP in the respective frames are the same, the length of the vertical blanking period BP is lengthened as the refresh rate is lowered.

In the vertical blanking period BP, since the driving voltage based on the image data signal is not applied to the display panel, the voltage value of the common voltage Vcom applied to the common electrode of the display panel gradually decreases over time as illustrated in FIG. 8. The vertical blanking period BP in the execution of the low RF driving RP2 is longer than the vertical blanking period BP in the execution of the high RF driving RP1. Accordingly, as illustrated in FIG. 8, the reduction amount of the common voltage Vcom in the vertical blanking period BP during the low RF driving RP2 is larger than the reduction amount of the common voltage Vcom in the vertical blanking period BP during the high RF driving RP1.

Therefore, caused by such fluctuation of the common voltage Vcom, as illustrated in FIG. 8, a visible luminance AY1 visually perceived in the display image in the high RF driving RP1 transitions to a visible luminance AY2 in accordance with the switching to the low RF driving RP2. Thus, this is considered to be visually perceived as a flicker.

Therefore, in the display device 100, the gamma compensation part 1332 is disposed to generate the compensation reference gamma voltages G_UH, G_UL, G_LH, and G_LL in which the amount of voltage fluctuation of the voltage of the common electrode CE of the display panel 20, that is, the common voltage Vcom is compensated.

Thus, the differences between the respective compensation reference gamma voltages G_UH, G_UL, G_LH, and G_LL and the feedback common voltage Vcom_FB are made always constant as illustrated in FIG. 6. Accordingly, the differences between the respective voltage values of the gradation voltages V0 to V255 and Y0 to Y255 generated on the basis of the compensation reference gamma voltages G_UH, G_UL, G_LH, and G_LL and the feedback common voltage Vcom_FB are also made always constant regardless of the fluctuation of the feedback common voltage Vcom_FB unless the image itself represented by the image data signal VPD is changed.

Figure 9:
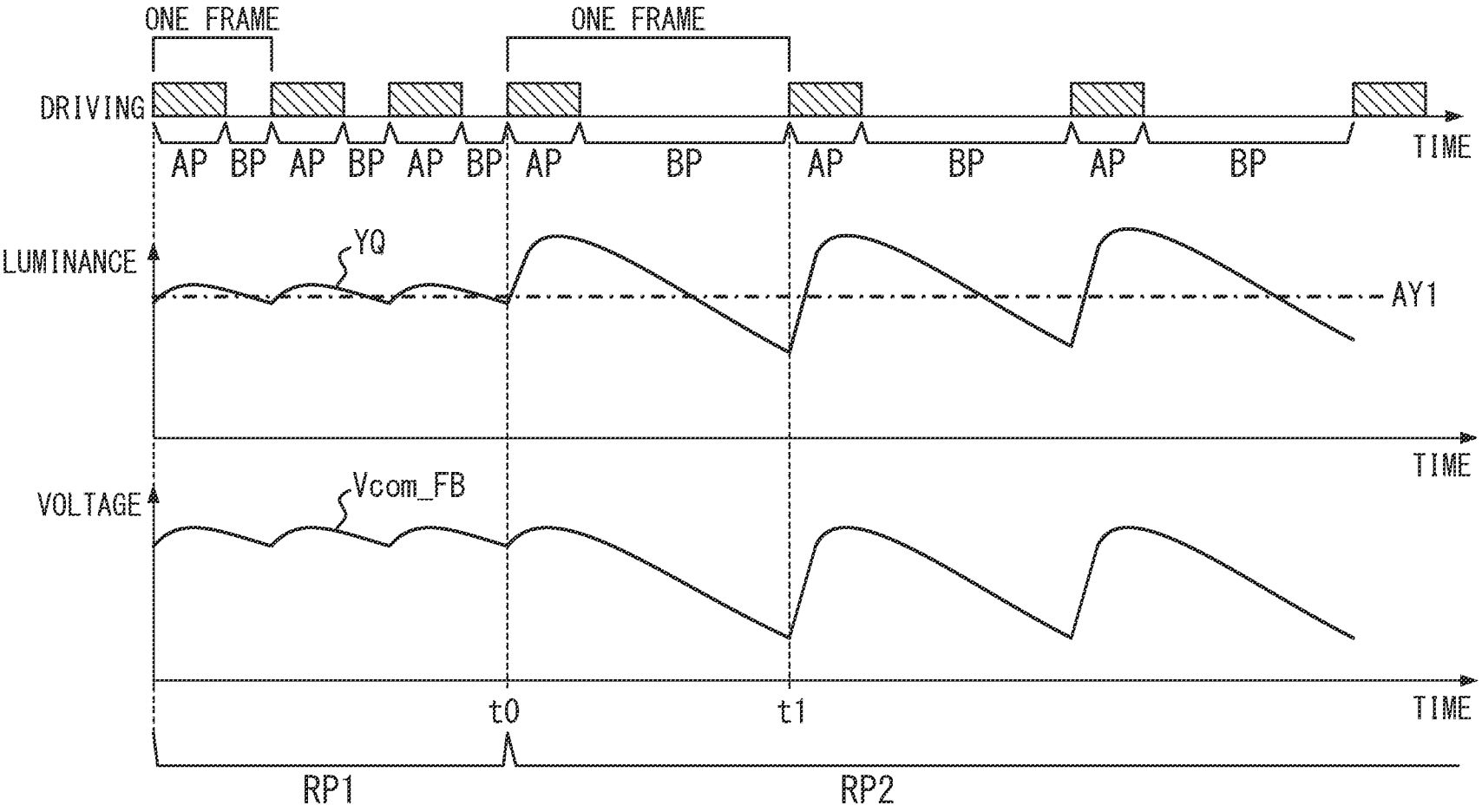
FIG. 9 is a waveform diagram illustrating an operation of suppressing the luminance change in the display image at the refresh rate change.

FIG. 9 is a waveform diagram illustrating the operation of suppressing the luminance change in the display image at the change of the refresh rate performed by the gamma compensation part 1332.

With the gamma compensation part 1332, regardless of whether the refresh rate has been changed or not, the gradation voltages V0 to V255 and Y0 to Y255 are constantly generated on the basis of the compensation reference gamma voltage G_UH, G_UL, G_LH, and G_LL in which the amount of voltage fluctuation of the common voltage Vcom is compensated.

Accordingly, as illustrated in FIG. 9, the change of the refresh rate as the switching from the high RF driving RP1 to the low RF driving RP2 is caused, and also for the common voltage Vcom, the visible luminance AY1 immediately before the switching is maintained before and after the time point t0 as the time point of the change.

Therefore, according to the present invention, since the change of the visible luminance can be quickly suppressed compared with a case where the gamma characteristic is adjusted from a time when the change of the refresh rate is detected, that is, the time point t0 illustrated in FIG. 9 at which the refresh rate is actually changed, to a time point t1 at which a period of one frame is elapsed, the flicker occurrence can be suppressed.

While the operation of suppressing the display luminance change is described in the above-described embodiment with the example of the fluctuation of the common voltage Vcom caused by the change of the refresh rate, the display luminance change can be quickly suppressed similarly also in a case where, for example, the common voltage Vcom is changed by receiving an external noise or the like.

While the four compensation reference gamma voltages (G_UH, G_UL, G_LH, G_LL) are used for generating the 512 gradation voltages (V0 to V256, Y0 to Y255) in the above-described embodiment, the numbers of the compensation reference gamma voltages and the gradation voltages are not limited to four and 256, respectively.

Basically, as the display driver according to the present invention, it is only necessary to include the common voltage generation part, the reference gamma voltage generation part, the gamma compensation part, the gradation voltage generating circuit, and the DA conversion part below.

The common voltage generation part (14) receives the reference common voltage (Vcom_RF), generates a common voltage (Vcom) by amplifying the reference common voltage, and applies it to the common electrode (CE) of the display panel (20). The reference gamma voltage generation part (1331) generates the first to k-th (k is an integer of 2 or more) reference gamma voltages (G_UH_RF, G_UL_RF, G_LH_RF, G_LL_RF) based on a predetermined gamma characteristic. The gamma compensation part (1332) takes in the voltage of the common electrode as the feedback common voltage (Vcom_FB) from the display panel. Then, by adjusting the voltage values of the respective first to k-th reference gamma voltages on the basis of the difference between the feedback common voltage and the reference common voltage, the first to k-th compensation reference gamma voltages (G_UH, G_UL, G_LH, G_LL) in which the fluctuation amount of the common voltage is compensated are generated. The gradation voltage generating circuit (1333) generates gradation voltages (V0 to V255, Y0 to Y255) on the basis of the first to k-th compensation reference gamma voltages. The DA conversion part (132) selects the gradation voltage corresponding to the display data piece from the gradation voltages for each of display data pieces corresponding to the respective display cells (PCs) based on the video signal, and supplies the selected gradation voltage as the driving voltage (G1 to Gn) to the display panel.

It is understood that the foregoing description and accompanying drawings set forth the preferred embodiments of the present invention at the present time. Various modifications, additions and alternative designs will, of course, become apparent to those skilled in the art in light of the foregoing teachings without departing from the spirit and scope of the disclosed invention. Thus, it should be appreciated that the present invention is not limited to the disclosed Examples but may be practiced within the full scope of the appended claims.

What is claimed is:

1. A display driver for driving a display panel on a basis of a video signal, the display panel including display cells and a common electrode connected to the display cells in common, the display driver comprising:

a common voltage generation part that receives a reference common voltage, generates a common voltage by amplifying the reference common voltage, and applies the common voltage to the common electrode;

a reference gamma voltage generation part that generates first to k-th (k is an integer of 2 or more) reference gamma voltages based on a predetermined gamma characteristic;

a gamma compensation part that takes in a voltage of the common electrode as a feedback common voltage from the display panel, and generates first to k-th compensation reference gamma voltages in which voltage values of the respective first to k-th reference gamma voltages are adjusted on a basis of a difference between the feedback common voltage and the reference common voltage;

a gradation voltage generating circuit that generates gradation voltages on a basis of the first to k-th compensation reference gamma voltages; and a DA conversion part that selects a gradation voltage corresponding to a display data piece from the gradation voltages for each of display data pieces corresponding to the respective display cells based on the video signal, and supplies the selected gradation voltage as a driving voltage to the display panel, wherein the gamma compensation part includes first to k-th compensation circuits that individually receive the first to k-th reference gamma voltages and individually generate the respective first to k-th compensation reference gamma voltages, and each of the first to k-th compensation circuits includes:

a first current source that generates a first constant current;

a first differential stage that flows currents to a first node and a second node, respectively, the currents being obtained by dividing the first constant current into two currents having a ratio relative to each other that is the same as a ratio of a magnitude of the feedback common voltage to a magnitude of the reference common voltage;

a second current source that generates a second constant current;

a second differential stage that flows currents to the first node and the second node, respectively, the currents being obtained by dividing the second constant current into two currents having a ratio relative to each other that is the same as a ratio of a magnitude of a reference gamma voltage to a magnitude of a compensation reference gamma voltage; and an amplifier that outputs a voltage obtained by amplifying voltages of the second node as the compensation reference gamma voltages.

2. The display driver according to claim 1, wherein the gamma compensation part generates the first to k-th compensation reference gamma voltages by adjusting the voltage values of the respective first to k-th reference gamma voltages so as to compensate for an amount of fluctuation of the common voltage, and the gamma compensation part obtains the first to k-th compensation reference gamma voltages by adding a difference to each of the first to k-th reference gamma voltages.

3. A display device comprising:

a display panel that includes display cells, a common electrode connected to the display cells in common, and first and second terminals connected to the common electrode; and a display driver that supplies driving voltages based on a video signal and a common voltage to the display panel, wherein the display driver includes:

a common voltage generation part that receives a reference common voltage, generates the common voltage by amplifying the reference common voltage, and applies the common voltage to the first terminal;

a reference gamma voltage generation part that generates first to k-th (k is an integer of 2 or more) reference gamma voltages based on a predetermined gamma characteristic;

a gamma compensation part that takes in a voltage of the second terminal as a feedback common voltage from the display panel, and generates first to k-th compensation reference gamma voltages in which voltage values of the respective first to k-th reference gamma voltages are adjusted on a basis of a difference between the feedback common voltage and the reference common voltage;

a gradation voltage generating circuit that generates gradation voltages on a basis of the first to k-th compensation reference gamma voltages; and a DA conversion part that selects a gradation voltage corresponding to a display data piece from the gradation voltages for each of display data pieces corresponding to respective display cells based on the video signal, and supplies the selected gradation voltage as the driving voltage to the display panel, wherein the gamma compensation part includes first to k-th compensation circuits that individually receive the first to k-th reference gamma voltages and individually generate respective first to k-th compensation reference gamma voltages, and each of the first to k-th compensation circuits includes:

a first current source that generates a first constant current;

a first differential stage that flows currents to a first node and a second node, respectively, the currents being obtained by dividing the first constant current into two currents having a ratio relative to each other that is the same as a ratio of a magnitude of the feedback common voltage to a magnitude of the reference common voltage;

a second current source that generates a second constant current;

a second differential stage that flows currents to the first node and the second node, respectively, the currents being obtained by dividing the second constant current into two currents having a ratio relative to each other that is the same as a ratio of a magnitude of a reference gamma voltage to a magnitude of a compensation reference gamma voltage; and an amplifier that outputs a voltage obtained by amplifying voltages of the second node as the compensation reference gamma voltages.

4. The display device according to claim 3, wherein the gamma compensation part generates the first to k-th compensation reference gamma voltages by adjusting the voltage values of the respective first to k-th reference gamma voltages so as to compensate for an amount of fluctuation of the common voltage, and the gamma compensation part obtains the first to k-th compensation reference gamma voltages by adding a difference to each of the first to k-th reference gamma voltages.

* * * * *